US006701720B1

(12) United States Patent
Stone et al.

(10) Patent No.: US 6,701,720 B1
(45) Date of Patent: Mar. 9, 2004

(54) GLOWABLE AND ENDOTHERMIC SLEEVE FOR BEVERAGE CONTAINER

(76) Inventors: Kevin M. Stone, 2445 Dillingham Rd., Virginia Beach, VA (US) 23456-6552; Renee Stone, 2445 Dillingham Rd., Virginia Beach, VA (US) 23456-6552

( * ) Notice: Subject to any disclaimer, the term of this patent is extended or adjusted under 35 U.S.C. 154(b) by 0 days.

(21) Appl. No.: 10/418,866

(22) Filed: Apr. 21, 2003

(51) Int. Cl.[7] ..... F25D 5/00; F25B 21/00
(52) U.S. Cl. ..... 62/4; 62/457.9
(58) Field of Search ..... 62/4, 60, 337, 62/338, 371, 452, 529, 457.9; 252/67, 71

(56) References Cited

U.S. PATENT DOCUMENTS 3,720,823 A * 3/1973 Black et al. ..... 240/2.25
4,268,567 A 5/1981 Harmony
4,751,616 A * 6/1988 Smithey ..... 362/34
4,823,974 A 4/1989 Crosser
4,871,597 A 10/1989 Hobson
5,001,907 A 3/1991 LaCroix et al.
5,029,049 A * 7/1991 Ladyjensky ..... 362/34
5,052,387 A 10/1991 Natali
5,651,254 A 7/1997 Berry
6,019,782 A 2/2000 Davis et al.
6,182,855 B1 2/2001 Alpert

* cited by examiner

*Primary Examiner*—Denise L. Esquivel
*Assistant Examiner*—Malik N. Drake
(74) *Attorney, Agent, or Firm*—Donald R. Schoonover

(57) ABSTRACT

A sleeve or a wrapper is used to keep liquid contained in a container, such as a glass or bottle or can, cool. The sleeve contains materials that generate light when activated and chemicals that absorb heat when combined. The light is generated in an upper portion of the sleeve while heat is absorbed in a lower portion of the sleeve. The sleeve can be re-used by storing the sleeve in a refrigerator or freezer after the initial use which does not require such pre-cooling.

6 Claims, 1 Drawing Sheet

GLOWABLE AND ENDOTHERMIC SLEEVE FOR BEVERAGE CONTAINER

BACKGROUND OF THE INVENTION

1. Field of the Invention

The present invention relates to the general art of containers, and to the particular field of wrappers for liquid containers.

2. Discussion of the Related Art

Many people consume liquid during various activities. Some of this liquid is for refreshment, and some of the liquid is necessary re-hydration during various activities. Often, consuming liquid is most enjoyable if the liquid is cold, or at least cooler than ambient temperature.

Accordingly, the art contains many examples of coolers and devices intended to maintain a liquid cool for extended periods of time even if that liquid is exposed to high temperature environments.

Some of these examples include wrappers or sleeves that are cooled in a refrigerator or freezer and then wrapped around a container. These sleeves work well, but have several drawbacks. As soon as the sleeve is removed from a freezer or from a refrigerator, it begins to warm up to ambient conditions. Thus, even if the sleeve is not immediately needed, its cooling ability immediately begins to degrade. Thus, some of the sleeve effectiveness is lost before it may actually be needed.

Therefore, there is a need for a sleeve or a wrap that is used to cool liquid in a container that will not begin to function until required.

Still further, if a sleeve must be chilled, pre-planning is required. That is, if someone wants to use a sleeve or a wrap to chill his or her drink, that person must plan ahead and place such a sleeve or wrap in a refrigerator or freezer so the sleeve or wrap is ready when desired. Such pre-planning may not always occur or be convenient.

Therefore, there is a need for a sleeve or a wrap that is used to cool liquid in a container that does not have to be pre-chilled prior to use.

Still further, such devices are often used when drinks are being consumed by a multiplicity of different people, such as at a party or the like. In such cases, people often leave their drink on a table or the like and forget it. If a plurality of people leave their drinks on a table, the drinks often become confused with each other. That is, one person does not know which is his or her drink. This generally results in a person simply getting a new drink. This can be wasteful and inconvenient.

Therefore, there is a need for a sleeve or a wrap that is used to cool liquid in a container that can be used to identify a particular drink and distinguish that drink from others.

To be most economical, a device such as a container wrapper should be re-usable. In this manner, the cost per use for the device will be reduced and will make the device attractive as well as versatile.

Therefore, there is a need for a sleeve or a wrap that is used to cool liquid in a container that can be re-used.

PRINCIPAL OBJECTS OF THE INVENTION

It is a main object of the present invention to provide a sleeve or wrapper for beverage containers for liquid that is versatile and cost effective.

It is another object of the present invention to provide a sleeve or a wrap, that is used to cool liquid in a container, that will not begin to function until required.

It is another object of the present invention to provide a sleeve or a wrap, that is used to cool liquid in a container, that does not have to be pre-chilled prior to use.

It is another object of the present invention to provide a sleeve or a wrap, that is used to cool liquid in a container, that can be used to identify a particular drink and distinguish that drink from others.

It is another object of the present invention to provide a sleeve or a wrap, that is used to cool liquid in a container, that can be re-used.

SUMMARY OF THE INVENTION

These, and other, objects are achieved by a wrapper for a liquid container which comprises a body which is shaped and sized to hold a liquid container, such as a drink glass or a can or a bottle therein and which includes a bottom on which the bottom of the liquid container will rest when the wrapper is in use. An upper portion of the body has substances stored therein that are activated to produce light when combined. Substances are stored in a lower portion of the body that absorb heat when combined. The upper portion contains one or more first frangible capsules containing a first substance that produces light when mixed with the second substance surrounding the one or more first frangible capsules. Similarly, the lower portion contains one or more second frangible capsules containing a third substance that causes an endothermic reaction when mixed with the fourth substance surrounding the one or more second frangible capsules.

The sleeve or wrap embodying the present invention can thus be activated when needed so no pre-planning is required and can also be reused so it is economical. The sleeve or wrap also can be used to distinguish one drink from another as well as to display logos or other advertising indicia or to simply produce a pleasing aesthetic effect, thereby increasing the effectiveness of the device.

BRIEF DESCRIPTION OF THE DRAWING FIGURES

DETAILED DESCRIPTION OF THE PREFERRED EMBODIMENT

Figure 1:
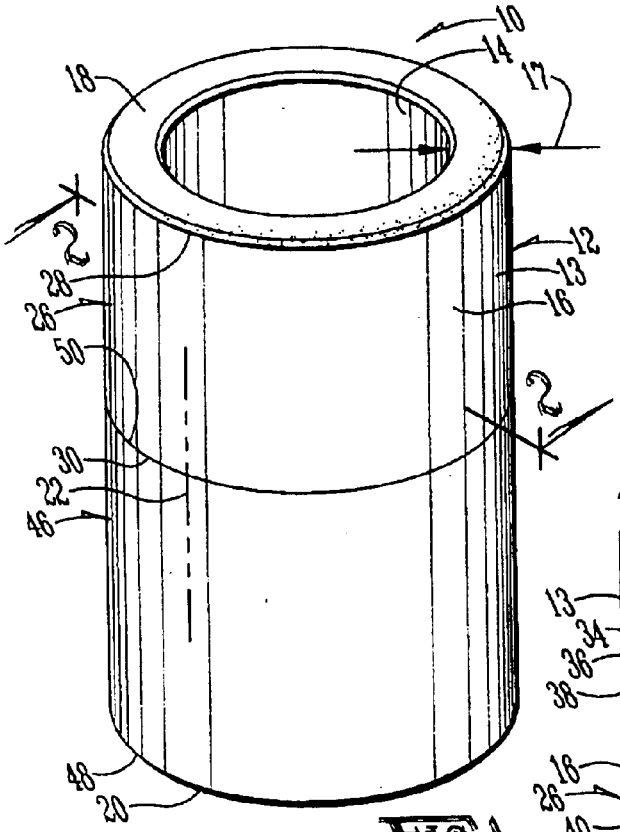
FIG. 1 is a perspective view of a sleeve for a container embodying the present invention.
Figure 2:
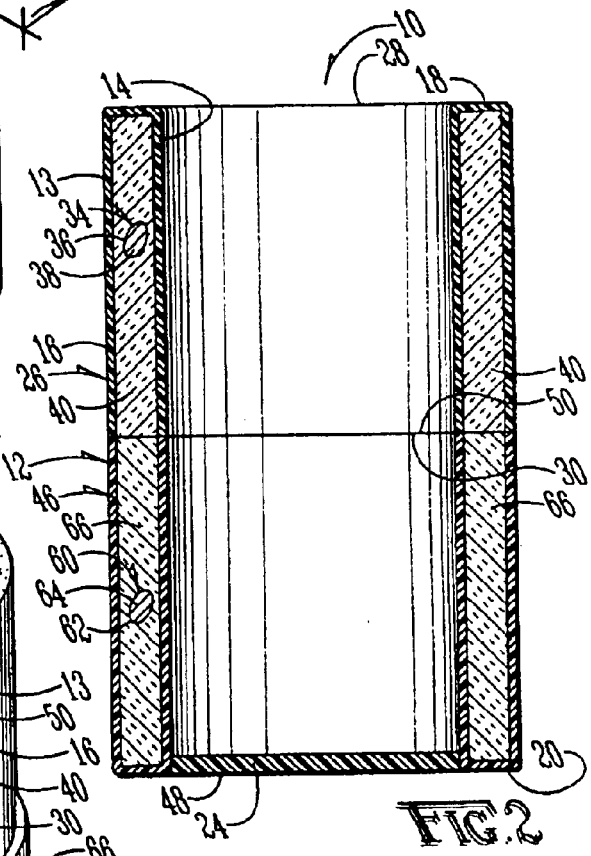
FIG. 2 is an elevational view of the sleeve for a container taken in cross-section along line 2—2 of FIG. 1.

Other objects, features and advantages of the invention will become apparent from a consideration of the following detailed description and the accompanying drawings.

Referring to the figures, it can be understood that the present invention is embodied in a wrapper or sleeve 10 for use with a liquid container (not shown), such as a drink glass, a bottle, or a can. Sleeve 10 comprises a cylindrical body 12 which is open at one end to slidably receive the liquid container. Body 12 is encased in a covering mechanism 13 having an inner surface 14 and an outer surface 16. The covering mechanism 13 is constructed of translucent or transparent material, which can be plastic, or other suitable material. A thickness dimension 17 extends between the inner surface 14 and the outer surface 16. Body 12 includes a first end 18, a second end 20, and an axial dimension 22, which extends between the first end 18 and the second end 20. A bottom 24 is located at the second end 20 and is constructed of plastic, or other suitable material, to support a liquid container associated with the sleeve 10.

Figure 3:
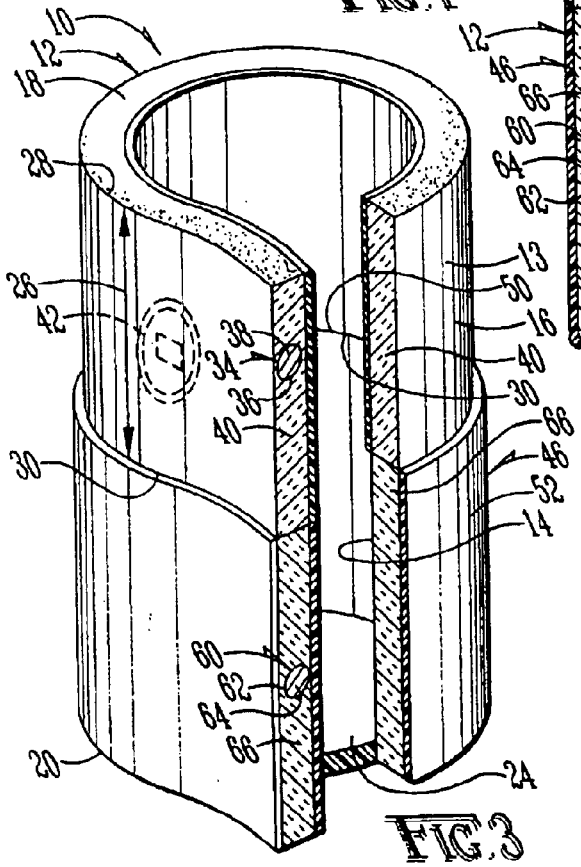
FIG. 3 is a perspective, split view of the sleeve for a container showing a first optional insulating layer, a second optional insulating layer, and capsules containing various substances for carrying out the functions of the present invention.

An upper portion 26 of the body 12 is located adjacent to the first end 18 of the body 12 and extends from adjacent to and spaced from the first end 18 in the direction of the axial dimension 22 of the body 12 toward the second end 20 of the body 12. The upper portion 26 has a first boundary 28 adjacent to the first end 18 and a second boundary 30 spaced apart from the first boundary 28 in the direction of the axial dimension 22 of the body 12. The inner surface of the upper portion 26 of the body 12 may be covered by a first optional insulating layer 32, as shown in FIG. 3.

One or more first frangible capsules 34 is embedded in only the upper portion 26 of the body 12. Each first frangible capsule 34 includes a frangible wall 36. Each first frangible capsule 34 is filled with a first substance 38. A second substance 40 surrounds the first frangible capsule 34 and extends throughout the upper portion 26 of the body 12. The first substance 38 and the second substance 40 are selected such that a chemiluminescent, or light-generating, reaction is produced when the first substance 38 and second substance 40 come in contact with each other, such as when the sleeve 10 is squeezed such that the frangible wall 36 of the one or more first frangible capsules 34 is ruptured. For example, the first substance 38 contained in the one or more first frangible capsules 34 may comprise hydrogen peroxide dissolved in phthalic ester, whereas the second substance 40 surrounding the one or more first frangible capsules 34 and extending throughout the upper portion 26 of the body 12 may comprise phenyl oxalate ester and fluorescent dye. It is to be understood that the first substance 38 and second substance 40 may comprise other suitable substances, the combination of which produces a light-generating reaction when activated as described herein.

Once the chemiluminescent reaction begins, the upper portion 26 of the sleeve 10 glows. Any printed material, such as logos or indicia 42, or the like, on or in the upper portion 26 of the body 12, as indicated in FIG. 3, will be visible. If either the chemiluminescent reaction produces a colored light or the covering mechanism 13 is constructed of colored material, or both, then the effect can be varied. A person can thus easily identify his or her drink from among a plurality of drinks by the color or light generated by the chemiluminescent reaction. The translucency or transparency material of the covering mechanism 13 will enhance this effect.

A lower portion 46 of the body 12 is located adjacent to the second end 20 of the body 12 and extends from adjacent to and spaced from the second end 20 in the direction of the axial dimension 22 of the body 12 toward the first end 18 of the body 12. The lower portion 46 has a third boundary 48 adjacent to the second end 20 and a fourth boundary 50 spaced apart from the first boundary 40 in the direction of the axial dimension 22 of the body 12. If desired, lower portion 46 of the body 12 may be covered by a second optional insulating layer 52, as shown in FIG. 3.

One or more second frangible capsules 60 is embedded in only the lower portion 46 of the body 12. Each second frangible capsule 60 includes a frangible wall 62. Each second frangible capsule 60 is filled with a third substance 64. A fourth substance 66 surrounds the one or more second frangible capsules 60 and extends throughout the lower portion 46 of the body 12. The third substance 64 and the fourth substance 66 are selected such that an endothermic, or heat-absorbing, reaction occurs when the third substance 64 and fourth substance 66 come in contact with each other, such as when the sleeve 10 is squeezed such that the wall 62 of the one or more second frangible capsules 60 is ruptured. For example, the third substance 64 contained in the one or more second frangible capsules 60 may comprise water, whereas the fourth substance 66 surrounding the one or more second frangible capsules 60 and extending throughout the lower portion 46 of the body 12 may comprise ammonium nitrate. It is to be understood that the third substance 64 and fourth substance 66 may comprise other suitable substances, the combination of which produces an endothermic, or heat-absorbing, reaction.

The frangible wall 62 of the second frangible capsule 60 is ruptured by squeezing the body 12 of the sleeve 10. Once the third substance 64 and the fourth substance 66 are combined by rupturing the wall 62, not only do these substances 64, 66 produce an endothermic, heat-absorbing reaction, the substances 64, 66 produce a substance that can be subsequently frozen once the body 12 reaches ambient temperature. Thus, the sleeve 10 can be re-used after the initial use by simply placing the sleeve 10 in a cool location, such as a freezer or the like. In other words, the initial use of the sleeve 10 need not be pre-planned.

It is to be understood that while certain forms of the present invention have been illustrated and described herein, it is not to be limited to the specific forms or arrangements of parts described and shown.

What is claimed and desired to be covered by Letters Patent is:

1. A wrapper for a liquid container comprising:

(a) a cylindrical body having
  (1) a covering mechanism with
    (A) an inner surface,
    (B) an outer surface formed of translucent or transparent material,
  (2) a thickness dimension extending between the inner surface and the outer surface,
  (3) a first end,
  (4) a second end,
  (5) an axial dimension extending between the first end and the second end,
  (6) a bottom at the second end, and
  (7) an upper portion adjacent to the first end and extending from adjacent to and spaced from the first end in the direction of the axial dimension of said body toward the second end of said body, the upper portion having a first boundary adjacent to and spaced from the first end and a second boundary spaced apart from the first boundary in the direction of the axial dimension of said body;

(b) one or more first frangible capsules embedded only in said upper portion of said body, each one or more first frangible capsules having a frangible wall, each first frangible capsule containing a firs t substance;

(c) a second substance surrounding each first frangible capsule and extending throughout said upper portion of said body wherein said second substance reacts with said first substance upon contacting the first substance to generate light in the upper portion of the body when the frangible wall of one or more of said first frangible capsules is ruptured;

(d) one or more second frangible capsules embedded only in said lower portion of said body, each one or more second frangible capsules having a frangible wall, each second frangible capsule containing a third substance; and (e) a fourth substance surrounding each second frangible capsule and extending throughout said lower portion of said body wherein said fourth substance reacts with said third substance upon contacting the third substance to absorb heat in the lower portion of the body when the frangible wall of one or more of said second frangible capsules is ruptured.

2. The wrapper as described in claim 1 further including a insulating layer spaced adjacent to an inside surface of said upper portion of said body.

3. The wrapper as described in claim 1 further including a insulating layer spaced adjacent to an outside surface of said lower portion of said body.

4. The wrapper as described in claim 1 wherein said first substance includes one of either hydrogen peroxide dissolved in phthalic ester or phenyl oxalate ester and fluorescent dye and said second substance includes the other one of said hydrogen peroxide dissolved in phthalic ester or phenyl oxalate ester and fluorescent dye.

5. The wrapper as described in claim 1 wherein said third substance includes one of either water or ammonium nitrate and said second substance includes the other one of said water or ammonium nitrate.

6. A wrapper for a liquid container comprising:

a) a body;

b) an upper portion of said body having chemiluminescent materials therein and which produce light when activated, said chemiluminescent materials being stored in one or more first frangible capsules embedded only in said upper portion of said body, each first frangible capsule storing a first one of said chemiluminescent materials and being surrounded by a second one of said chemiluminescent materials, each said first frangible capsule having a first frangible wall that prevents said first and second chemiluminescent materials from being activated until said first frangible wall is ruptured; and c) a lower portion of said body having endothermic materials therein and which absorb heat when activated, said endothermic materials being stored in one or more second frangible capsules embedded only in said lower portion of said body, each second frangible capsule storing a first one of said endothermic materials and being surrounded by a second one of said endothermic materials, each said second frangible capsule having a second frangible wall that prevents said first and second endothermic materials from being activated until said second frangible wall is ruptured.

* * * * *